US011684931B2

(12) United States Patent
Aanesbug et al.

(10) Patent No.: US 11,684,931 B2
(45) Date of Patent: Jun. 27, 2023

(54) CLEANING ASSEMBLY FOR MAGNET ASSEMBLIES

(71) Applicant: JAGTECH AS, Orkanger (NO)

(72) Inventors: Geir Olav Aanesbug, Meldal (NO); Jan Egil Pallin, Heimdal (NO)

(73) Assignee: JAGTECH AS, Orkanger (NO)

( * ) Notice: Subject to any disclaimer, the term of this patent is extended or adjusted under 35 U.S.C. 154(b) by 298 days.

(21) Appl. No.: 17/049,188

(22) PCT Filed: Apr. 8, 2019

(86) PCT No.: PCT/NO2019/050071

§ 371 (c)(1),
(2) Date: Oct. 20, 2020

(87) PCT Pub. No.: WO2019/203656

PCT Pub. Date: Oct. 24, 2019

(65) Prior Publication Data

US 2021/0237099 A1 Aug. 5, 2021

(30) Foreign Application Priority Data

Apr. 20, 2018 (NO) ..... 20180544

(51) Int. Cl.
*B03C 1/28* (2006.01)
*B03C 1/033* (2006.01)
(Continued)

(52) U.S. Cl.
CPC ..... *B03C 1/286* (2013.01); *B03C 1/0332* (2013.01); *B08B 1/005* (2013.01); *B08B 1/008* (2013.01);
(Continued)

(58) Field of Classification Search
CPC .. B03C 3/74; B03C 1/032; B03C 3/88; B03C 3/68; B03C 3/746; B03C 3/763
See application file for complete search history.

(56) References Cited

U.S. PATENT DOCUMENTS 5,066,390 A 11/1991 Rhodes et al.
2003/0173264 A1 9/2003 Yang
(Continued)

FOREIGN PATENT DOCUMENTS

DE 3218791 A1 3/1983
FR 2718065 A1 * 10/1995 ..... B01D 35/16
WO WO-2013071912 A1 * 5/2013 ..... B03C 1/18

OTHER PUBLICATIONS

Machine translation of FR2718065A1, pp. 1-3. (Year: 2022).*
(Continued)

*Primary Examiner* — Ryan B Huang
(74) *Attorney, Agent, or Firm* — Alix, Yale & Ristas, LLP

(57) ABSTRACT

Separate cleaning assembly for magnet assemblies formed by at least one magnet rod, wiper assembly and magnet handle device, the cleaning assembly including a base and vertically extending main body, wherein the cleaning assembly includes retaining means for retaining the magnet assembly to the main body and receiving means for receiving and accommodating the wiper assembly, wherein the receiving means for the wiper assembly is arranged to moving means arranged for moving the wiper assembly in longitudinal direction of the magnet rods.

11 Claims, 8 Drawing Sheets

(51) Int. Cl.
*B08B 1/00* (2006.01)
*E21B 31/06* (2006.01)

(52) U.S. Cl.
CPC ..... *B03C 2201/18* (2013.01); *B03C 2201/28* (2013.01); *E21B 31/06* (2013.01)

(56) References Cited

U.S. PATENT DOCUMENTS

| | | | | |
|---|---|---|---|---|
| 2010/0065504 | A1 | 3/2010 | Yen et al. | |
| 2011/0139722 | A1* | 6/2011 | Simonson ..... | F17D 3/16 210/695 |
| 2011/0203976 | A1 | 8/2011 | Baker | |
| 2016/0214117 | A1 | 7/2016 | Jackson et al. | |

OTHER PUBLICATIONS

Machine translation of WO2013/071912. (Year: 2022).*
International Search Report and Written Opinion dated Jun. 26, 2019 (PCT/NO2019/050071).

* cited by examiner

CLEANING ASSEMBLY FOR MAGNET ASSEMBLIES

BACKGROUND

The disclosed embodiments relate to a cleaning assembly for magnet assemblies. The disclosed embodiments further relate to a cleaning assembly for magnet assemblies used for capturing and removing magnetic material in a flow of material.

Magnetized bars are used to remove magnetic/metal material, such as metal cuttings, metal shavings, metal parts, and the like, in a flow of material, such as in a fluid stream of oil well drilling mud or flow of raw material. Removal of the metal cuttings, metal shavings, metal parts captured by the magnetized bars can be performed by the use of a non-magnetic wiper assembly arranged slidable upon the magnetized bar between the ends thereof for removal of the captured metal from the magnetized bar.

Many of the metal parts that are collected by the magnetized bars, also known as ditch magnets, are pieces that have been cut or shaved and are thus of irregular shape and can have sharp edges/points, or the like. Safety is very important and meaningful in such operations including personnel handling equipment like this, especially in the oil and gas industry. Cuttings that are collected by a ditch magnet can include sharp edged debris that could possibly cut the hand of a worker who handles the ditch magnet. In prior art solutions personnel handling such magnetized bars are exposed due to manual handling of wiper assemblies for removing collected metal cuttings, metal shavings or metal parts on the magnet rods.

Cuttings that have been retrieved from a ditch magnet can provide information that is beneficial to oil and gas well operators. These collected cuttings may indicate casing wear during ordinary drilling operations, pipe wear, or any other factor which could be used for economic or maintenance considerations. The prior art fails to provide a solution where one in a simple manner can collect and register the collected cuttings.

This can also be used for detecting irregular operative incidents when it is detected high amount of magnetic material on the magnet assemblies, which is not expected during normal operation. This can indicate damage of used mechanical equipment. There is accordingly a need for a cleaning assembly that can clean with high frequency such that incidents like this can be detected rapidly by reporting from logging equipment.

Such magnet rods/bars are known from e.g. U.S. Pat. Nos. 5,043,063, 5,188,239, 8,641,899, 5,190,159 and NO20131274, as well as WO2016159779 in the name of the applicant. Some of them describe manual cleaning of the magnet rods, while some of them describe an automated approach for cleaning the magnet rods. A disadvantage with all these solutions, are as mentioned above that the safety of personnel is not ensured. Further, all the solutions which describe an automated approach requires that they are arranged in immediate vicinity of the magnet rods, i.e. as an integrated part of the device holding the magnet rods.

SUMMARY

The disclosed embodiments provide a separate cleaning assembly for magnet assemblies partly or entirely solving the disadvantages of prior art solutions.

The disclosed embodiments further provide a separate cleaning assembly for magnet assemblies that increases the Environment and Safety (HSE) for personnel.

Provided herein is a separate cleaning assembly for magnet assemblies where the removal of cuttings is performed in a safe and separated environment with no exposure for personnel in the vicinity.

Also provided herein is a separate cleaning assembly for magnet assemblies arranged to collect and retain cuttings removed from the magnet assemblies.

Also provided herein is a separate cleaning assembly for magnet assemblies arranged for automated removal of the cuttings, i.e. without personnel having to be in contact with the cuttings.

Also provided herein is a separate cleaning assembly for magnet assemblies arranged for weighing cuttings removed from the magnet assemblies.

Also provided herein is a separate cleaning assembly for magnet assemblies which can be arranged to a robot solution retrieving the magnet assemblies from a device for capturing and removing magnetic material in a flow of material, cleaning the magnet assemblies and inserting them back in the device after cleaning.

The inventive embodiments are related to a separate cleaning assembly for magnet assemblies formed by at least one magnet rod, wiper assembly and magnet handle device, wherein the wiper assembly is movable in longitudinal direction of the at least one magnet rod.

According to the inventive embodiments, the cleaning assembly comprises a base and a vertically extending main body, extending from the base and upwards. In an alternative embodiment, the main body and base are formed as one piece.

The cleaning assembly further comprises retaining means for retaining the magnet assembly to the main body and receiving means for receiving and accommodating the wiper assembly. The cleaning assembly further comprises moving means, to which moving means the receiving means for the wiper assembly is arranged, wherein the moving means is arranged to move the wiper assembly in longitudinal direction of the magnet rods.

According to one embodiment of the separate cleaning assembly, the moving means for the wiper assembly comprises a driving unit arranged movable in longitudinal direction of a vertically extending column, integrated or arranged to the main body.

In one embodiment of the separate cleaning assembly, the vertically extending column is provided with a longitudinally extending guide track, at a longitudinal side thereof, and the driving unit is extending through the longitudinally extending track and is arranged movably to a vertically extending shaft arranged in the vertically extending column. The driving unit is arranged to a driving source/arrangement or provided with a driving source/arrangement for moving the driving unit up and down the vertical shaft.

According to one embodiment of the separate cleaning assembly, the retaining means for retaining the magnet assembly is formed by two mirror doors pivotably arranged to the main body at upper end and the base at lower end. Further, the mirror doors are provided with upper end plates provided with corresponding recesses in contact surfaces thereof, arranged such that when the mirror doors connect each other the recesses are adapted to receive, accommodate and retain the magnet handle device of the magnet assembly and thus retain the magnet assembly to the main body and base. Accordingly, in this embodiment the mirror doors have two functions, wherein the first is to retain the magnet assembly, and the second is to close the cleaning assembly to provide a closed environment wherein cleaning of the magnet assemblies can be performed. The mirror doors can further be arranged to driving means for opening or closing the doors and/or locking means for locking the doors in closed and/or open position.

In an alternative embodiment retaining means can be arranged to the main body, above the receiving means for the wiper assembly.

According to a further embodiment of the separate cleaning assembly, the cleaning assembly is provided with weighing means, such as a load cell, arranged at lower part of the cleaning assembly, for weighing removed material from the magnet assembly collected in a container or box. There can further be arranged a scale exterior of the separate cleaning assembly for reading the measurements of the load cell.

In a further embodiment of the separate cleaning assembly, it can further be provided with a communication unit, wireless and/or wired, enabling one-way or two-way communication with the cleaning assembly. This will also enable the measurements of the load cell to be transferred to external systems.

According to a further embodiment of the separate cleaning assembly, the separate cleaning assembly is arranged to a manipulator system for insertion and removal of magnet assemblies to/from the separate cleaning assembly.

The separate cleaning assembly will further be provided with a power source, in the form of a chargeable unit, such as batteries, and/or power grid connector, and possibly energy harvester device(s).

The separate cleaning assembly will further be provided with a control device provided with means and/or software for controlling driving source/arrangement for moving the driving unit and/or driving means for the doors, and communication unit.

The separate cleaning assembly can be arranged for manual, semi-automatic and/or automatic cleaning of magnet assemblies.

Accordingly, a separate cleaning assembly for magnet assemblies which does not need to be arranged together with a device for capturing and removing magnetic material in a flow of material containing one or more magnet assemblies is provided. The separate cleaning assembly can be arranged where the user desires and has space for it. It is a well-known fact that space is an issue on rigs and other installations, which does not allow the cleaning assembly to be arranged together with the mentioned device. With the disclosed embodiments one can thus arrange the cleaning assembly in a suitable location.

The magnet assemblies can thus be removed from the mentioned device and inserted into the separate cleaning assembly with the mirror doors in open position where the wiper assembly is received and accommodated in the receiving assembly. The mirror doors are then closed and the recesses in the end plates therein enclose and retain the magnet assembly. The moving means can then be activated whereupon the wiper assembly is moved in longitudinal direction of the at least one magnet rods, cleaning the magnet rod for material collected on exterior surface thereof. The removed material is then collected in the box or container and weighed by the weighing means. After the cleaning process is completed the doors are again opened and the magnet assembly can be removed from the cleaning assembly and re-inserted into the mentioned device.

BRIEF DESCRIPTION OF THE DRAWINGS

The inventive embodiments will below be described in further detail with references to the attached drawings, where.

DETAILED DESCRIPTION

Figure 1A:
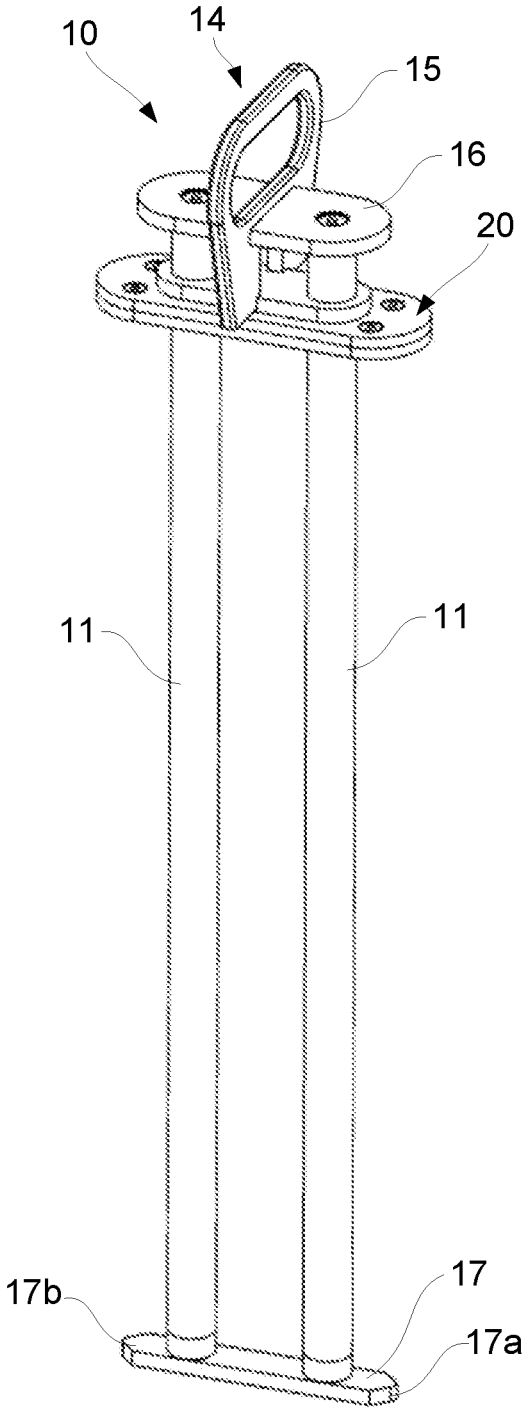
FIGS. 1A and 1B are principle drawings of prior art magnet assemblies for a device for capturing and removing magnetic material in a flow of material.
Figure 1B:
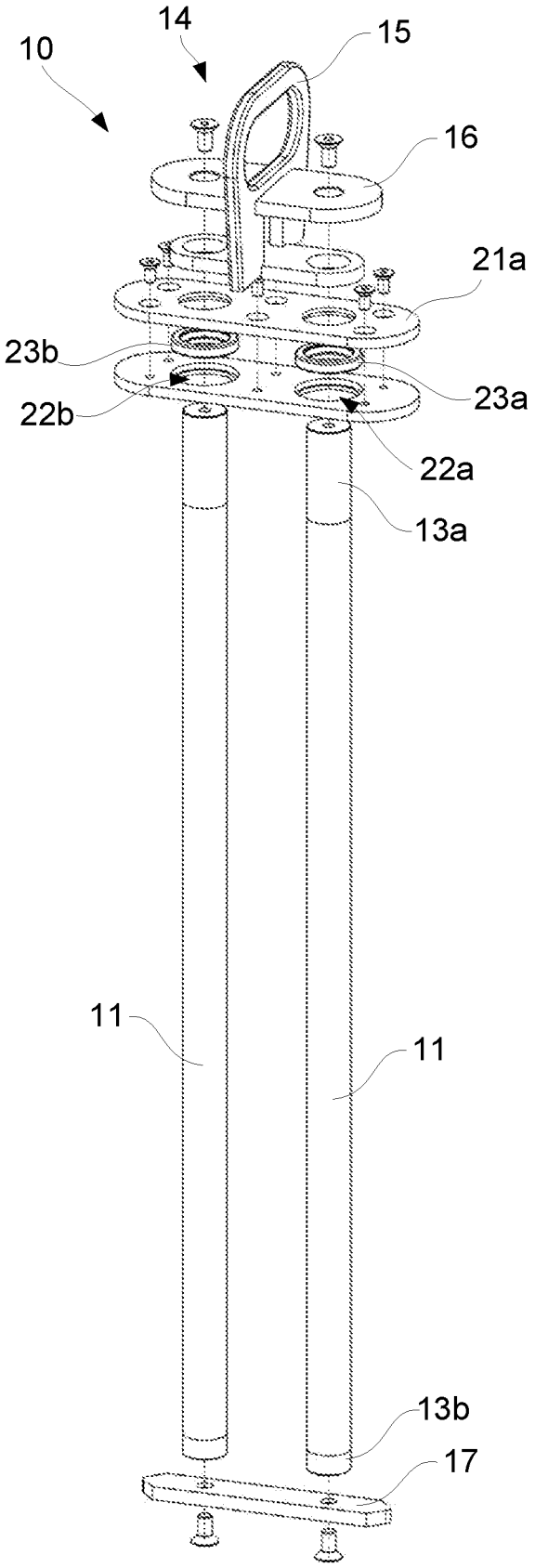

Reference is now made to FIGS. 1A and 1B showing principle drawings of magnet assembly 10 according to prior art, as described in WO2016159779 in the name of the applicant, which also describe a device for capturing and removing magnetic material in a flow of material, the content of which is included herein by reference. The magnet assembly 10 according to the example comprises a set of at least two magnet rods 11 in the form of permanent magnets, enclosed in a non-magnetic sleeve or material, and where upper and lower ends 13*a*, 13*b* thereof do not contain magnets. Even if permanent magnet rods 11 hereafter will be used as the example, this does not limit the exemplary embodiments as also other magnet rods can be used, such as controllable magnet rods. The permanent magnet rods 11 are at upper end fixed to a magnet handle device 14 formed by a handle 15 and a fixation plate 16 having a mainly elliptic shape. At the lower end the permanent magnet rods 11 are fixed to a magnet guider 17 having a mainly elliptic shape with tapering distal ends 17*a-b*.

The magnet assembly 10 further includes a wiper assembly 20 formed by upper and lower scraper bodies 21*a* and 21*b* having a mainly elliptic shape provided with through holes 22*a-b* for accommodating the permanent magnet rods 11. Between the scraper bodies 21*a-b* and in connection with the through holes 22*a-b* are arranged metal wipers 23*a-b* of non-magnetic material, one for each permanent magnet rod 11, which metal wipers 23*a-b* having a central opening adapted to outer surface of the permanent magnet rods 11. In this way the metal wipers 23*a-b* are movably arranged along the permanent magnet rods 11 by means of the scraper bodies 21*a-b*.

Even though the example above is showing magnet assemblies 10 comprising two magnet rods 11, the exemplary embodiments are also related to magnet assemblies 10 comprising one magnet rod 11 or more than two magnet rods 11, with a magnet handle device 14 and wiper assembly 20.

Reference is now made to FIGS. 2A-2F which are principle drawings of separate cleaning assembly 100 for magnet assemblies 10. The separate cleaning assembly 100 according to the exemplary embodiments is formed by a base 110 and main body 120 extending upwards from the base 110, as well as retaining means 130*a-b* for retaining the magnet assembly 10, and receiving means 140 for receiving and accommodating the wiper assembly 20 of the magnet assembly 10.

In the shown embodiment the retaining means 130*a-b* are formed by two mirror doors 131*a-b*, arranged pivotable to the main body 120 at upper side and the base 110 at lower side thereof.

The mirror doors 131*a-b* exhibit in the shown example a mainly triangular elongated shape which at lower end is provided with an exterior extending flange 132*a-b* provided with a hole 133*a-b* for connection to the base 110 via a pin or bolt (not shown). At the upper end the mirror doors 131*a-b* are provided with an end plate 134*a-b* provided with an extending part with a hole 135*a-b* (FIGS. 2D and 2E) for connection to upper side of the main body 120 via a pin or bolt (not shown). The mirror doors 131*a-b* can further be arranged to driving means (not shown) for opening or closing the mirror doors 131*a-b* and/or locking means (not shown) for locking the doors in closed and/or open position.

Figure 2A:
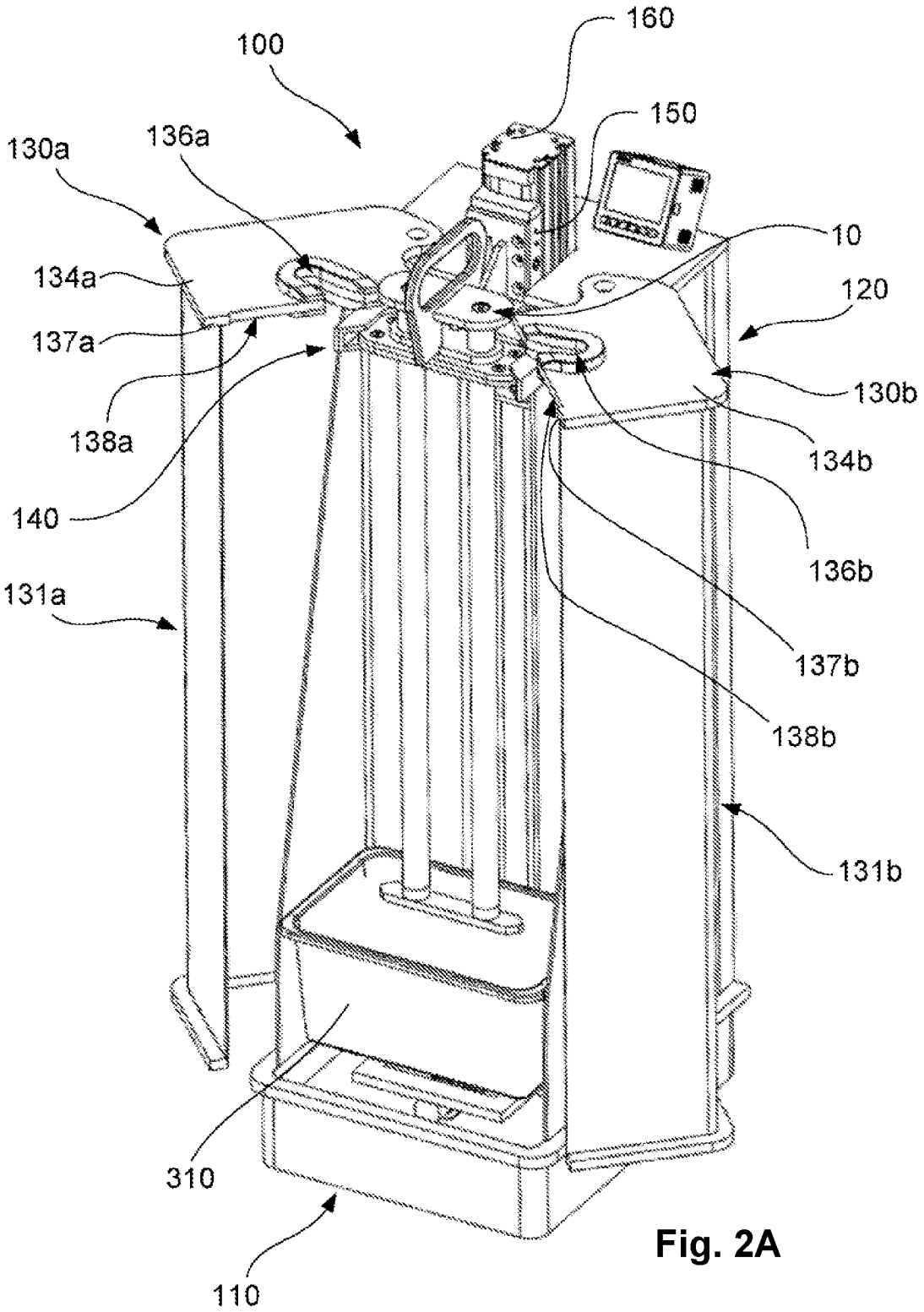
FIGS. 2A-2F are principle drawings of an embodiment of a cleaning assembly according to the disclosed embodiments.
Figure 2B:
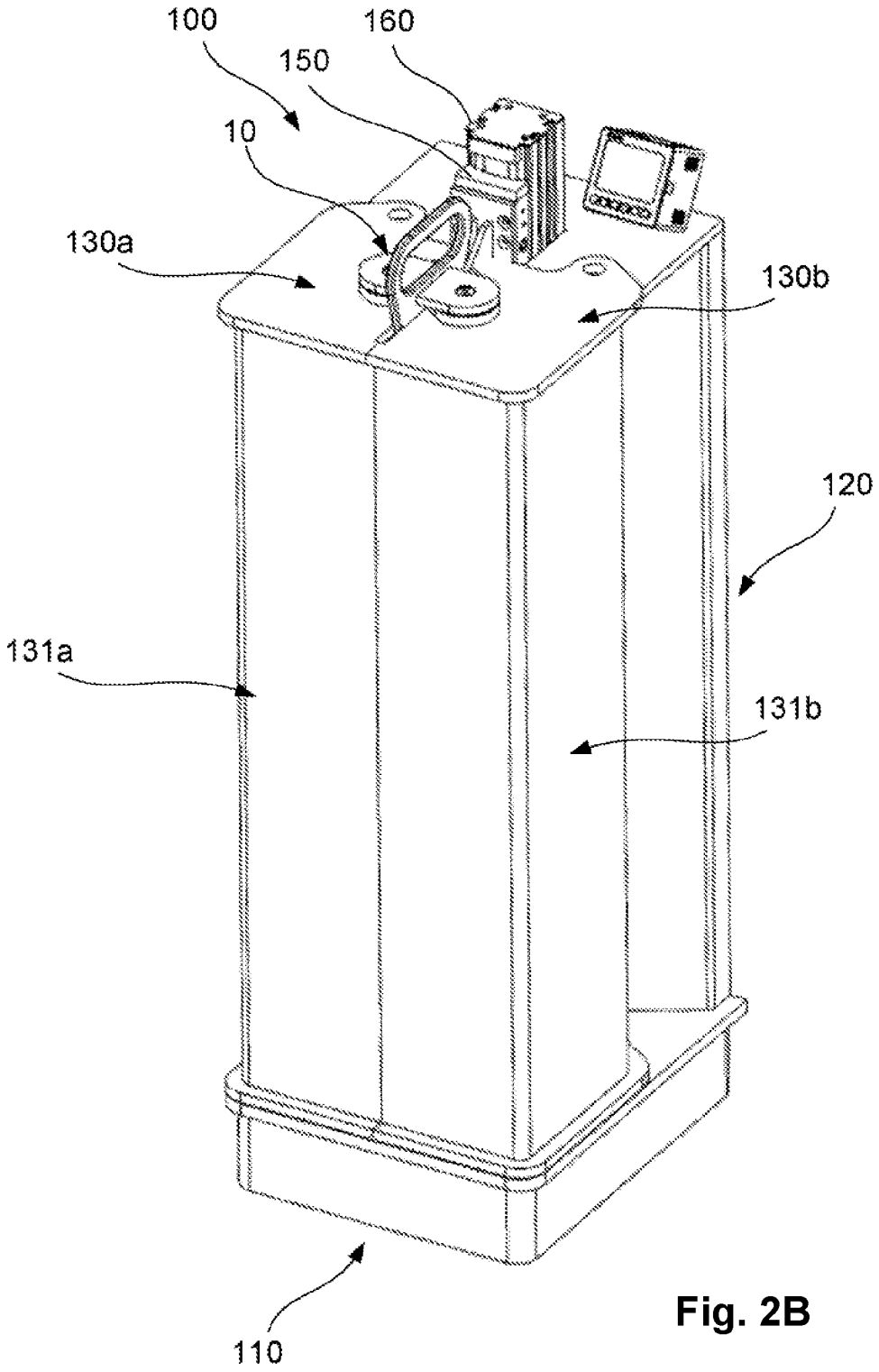
Figure 2C:
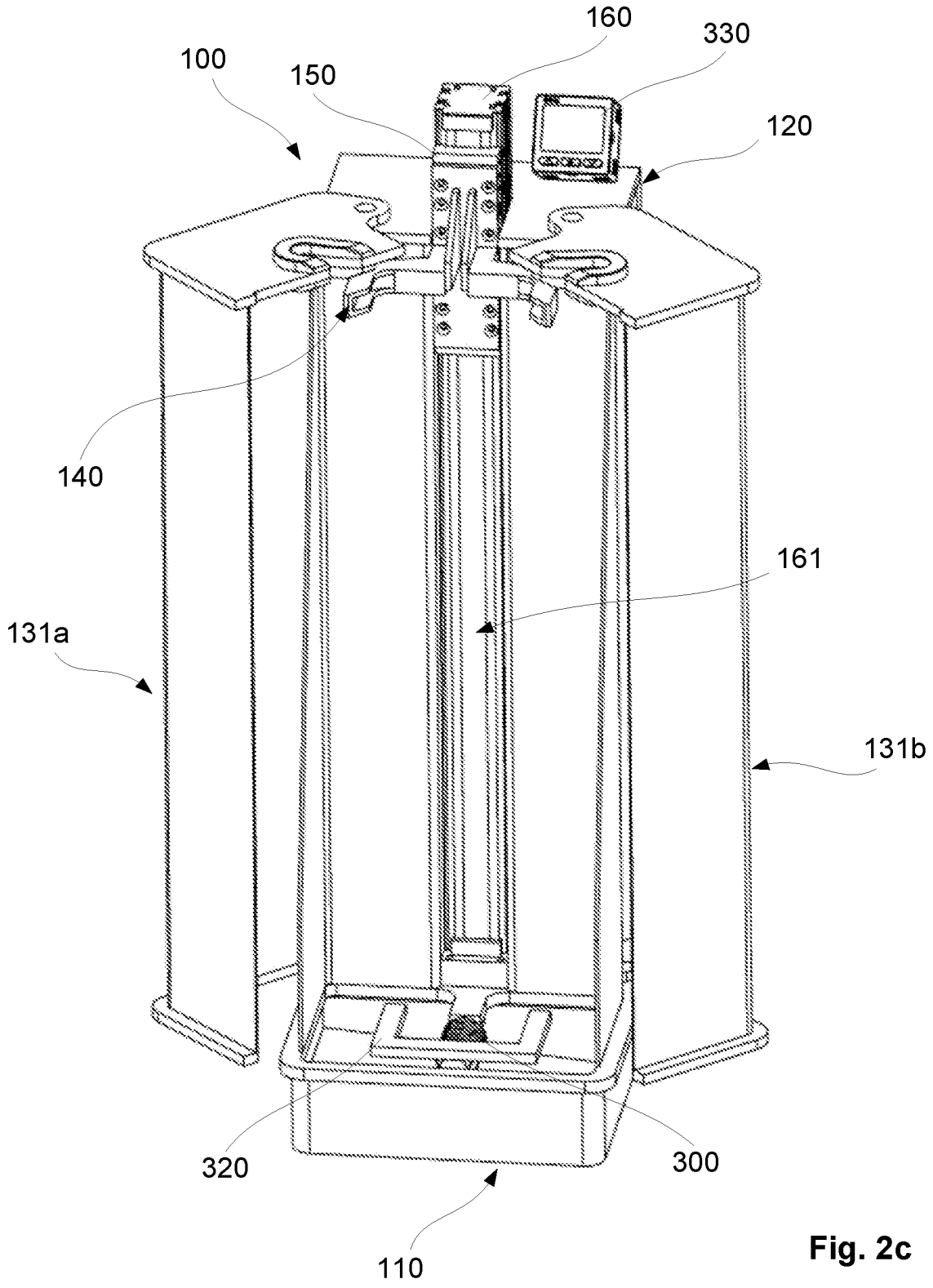
Figure 2D:
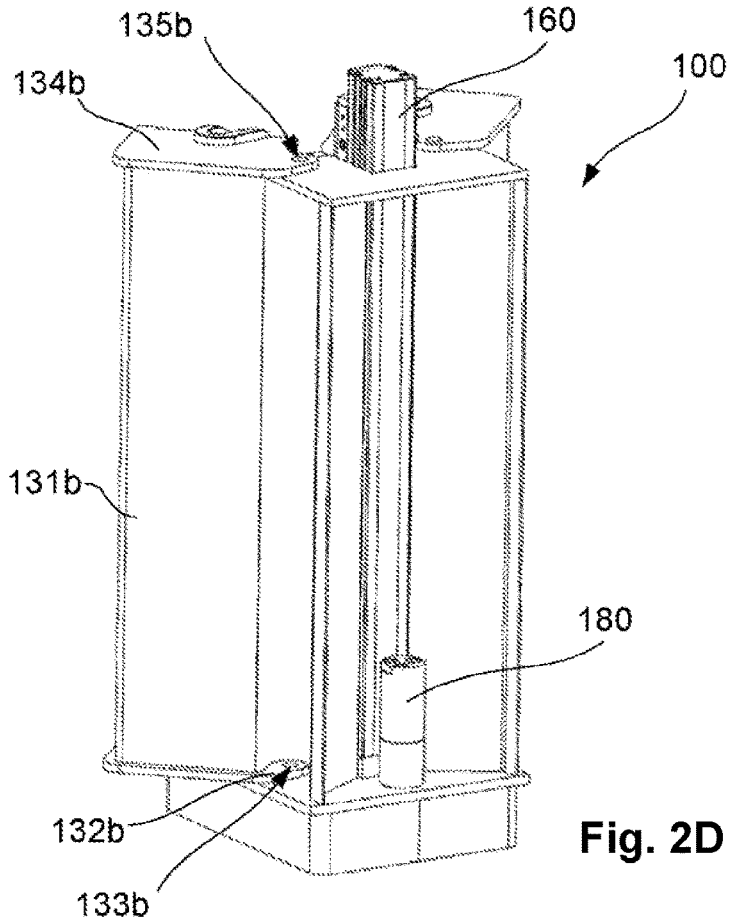
Figure 2E:
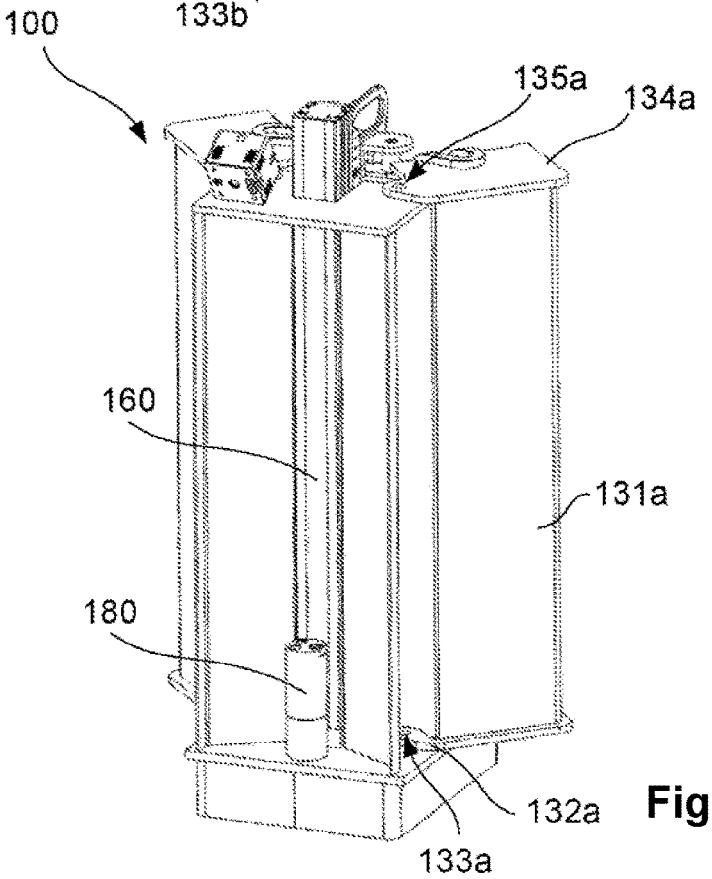

For retaining the magnet assembly 10 the end plates 134*a-b* of the mirror doors 131*a-b* are provided with corresponding recesses 136*a-b* at contact surfaces 137 thereof, such that when the mirror doors 131*a-b* are in contact with each other, the recesses 136*a-b* are adapted to receive, accommodate and retain the magnet handle device 14 of the magnet assembly 10, and thus retain the magnet assembly 10, as shown in FIG. 2C. The contact surfaces 137*a-b* of the mirror doors 131*a-b* are further provided with recesses 138*a-b* adapted the handle 15 of the magnet assembly 10 allowing the mirror doors 131*a-b* to entirely contact each other with the contact surfaces 137*a-b*.

The base 110, main body 120 and retaining means 130*a-b*/mirror doors 131*a-b* thus form a mainly rectangular housing or container with doors 131*a-b* that can be opened, as shown in FIG. 2A, to receive a magnet assembly 10, and closed, as shown in FIG. 2B, to retain the magnet assembly 10.

The receiving means 140 for receiving and accommodating the wiper assembly 20 of the magnet assembly 10 is e.g. formed by a clamp, adapted the shape and size of the wiper assembly 20. According to the exemplary embodiments the receiving means 140 for the wiper assembly 20 is arranged to a driving unit 150 arranged to move the wiper assembly 20 in longitudinal direction of the magnet rod(s) 11 of the magnet assembly 20. The receiving means 140 can further be provided with locking means for locking the wiper assembly 20 when inserted therein for increased safety during operation.

Figure 2F:
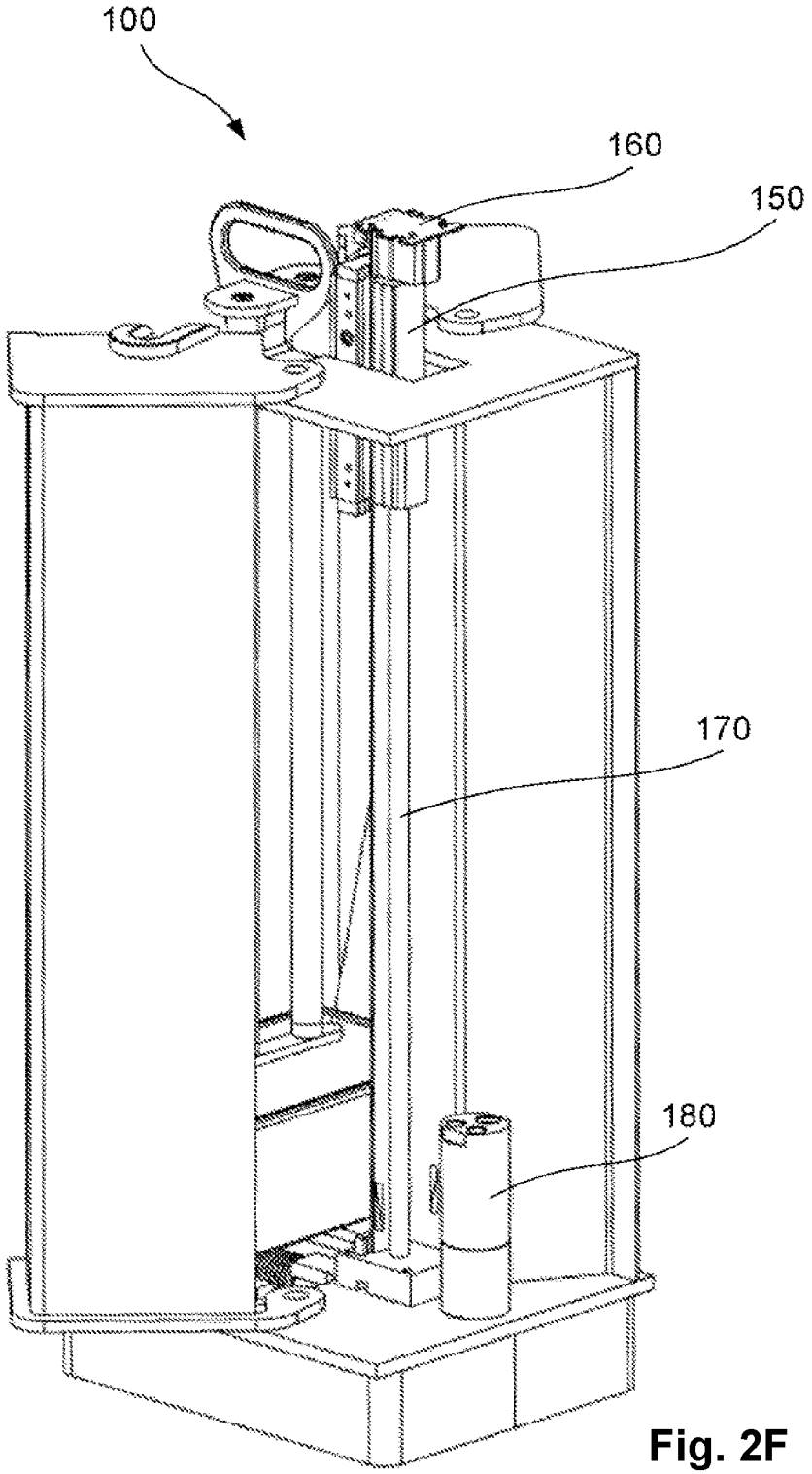

In shown embodiment the separate cleaning assembly 100 the driving unit 150 is arranged movable in longitudinal direction of a vertically extending column 160, integrated or arranged to the main body 120. In the shown embodiment, the vertically extending column 160 is provided with a longitudinally extending guide track 161 (FIG. 2C), at a longitudinal side thereof facing the magnet assembly 10/receiving means 140, and the driving unit 140 is extending through the longitudinally extending track 161 and is arranged movably to a vertically extending shaft 170 arranged in the vertically extending column 160, as shown in FIG. 2F where several parts have been removed revealing interior details.

Different solutions can be implemented for moving the driving unit 150 up and down along the vertically extending shaft 170 in the vertically extending column 160. E.g. the driving unit 150 can be provided with an electric motor with a shaft with a toothed wheel arranged thereto which is in engagement with a toothed rack arranged in the vertically extending shaft 170. Another example is that the driving unit 150 is provided with an electric motor with a shaft provided with driving wheels with high friction in engagement with the vertically extending shaft 170.

In yet another example the vertically extending shaft 170 is provided with threads (lead screw) and the driving unit 150 is provided with a threaded section/element (e.g. a nut) in engagement with the threads of the vertically extending shaft 170, and the vertical shaft 170 is arranged rotatable in the vertically extending column 160 and driven by an electric motor 180 arranged to the base 110, with transmission means (not shown) between the electric motor and vertically extending shaft arranged in the base 110. In this way, when the vertically extending shaft 170 rotates the driving unit 150 due to the threaded section/element will be moved downwards when the vertically extending shaft 170 is rotated in one direction and upwards when the vertically extending shaft 170 is rotated in the opposite direction.

Accordingly, with the magnet assembly 10 retained by the retaining means 130*a-b*, movement of the driving unit 150 as described above results in that the wiper assembly 20 is moved downwards or upwards along the magnet rods 11 and perform cleaning.

The driving mechanism of the driving unit 150 can also be realized with a belt drive instead of a lead screw.

Other solutions will be apparent for a skilled person.

Accordingly, a magnet assembly 10 can be inserted into the separate cleaning assembly 100 by opening the doors 131*a-b* and wherein the magnet assembly 10 is received and held by that the wiper assembly 20, in upper position, is received and held by the receiving means 140. The mirror doors 131*a-b* are then closed and the recesses 136*a-b* receive, accommodate and enclose the magnet handle device 14 of the magnet assembly 10 and retain the magnet assembly 10. The driving unit 150 can then be activated and move the wiper assembly 20 downwards and upwards along the magnet rods 11 removing material attached thereto, one or several times until all material are removed from the exterior surface of the magnet rods 11. After the cleaning is completed, the mirror doors 131*a-b* are again opened and the magnet assembly 10 is ready for use.

According to a further embodiment, the separate cleaning assembly 100 is further provided with weighing means 300 for weighing the removed material. For this the separate cleaning assembly 100 can be provided a load cell 300 arranged at lower part of the main body 120 or in the base 110, such that removed material (cuttings) can be registered. The removed material is preferably collected in a box or container 310 arranged on a collar 320 (FIG. 2C) arranged to the load cell 300. The results of the measurement of the load cell 300 is preferably shown on a scale 330 arranged exterior of the cleaning assembly 100 or transferred to an exterior unit by means of the cleaning assembly 100 comprising a communication device.

Figure 3A:
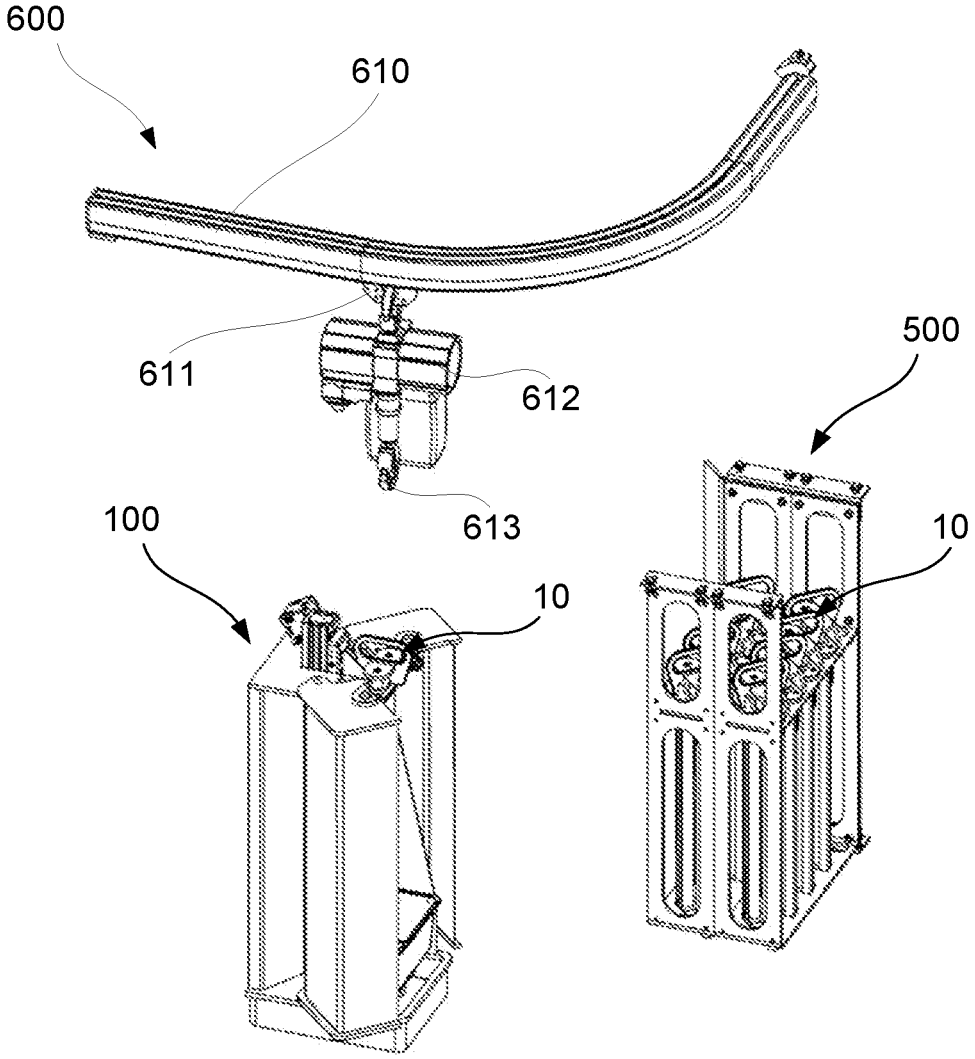
FIGS. 3A and 3B are principle drawings of the use of manipulator systems with the separate cleaning assembly according to the disclosed embodiments.
Figure 3B:
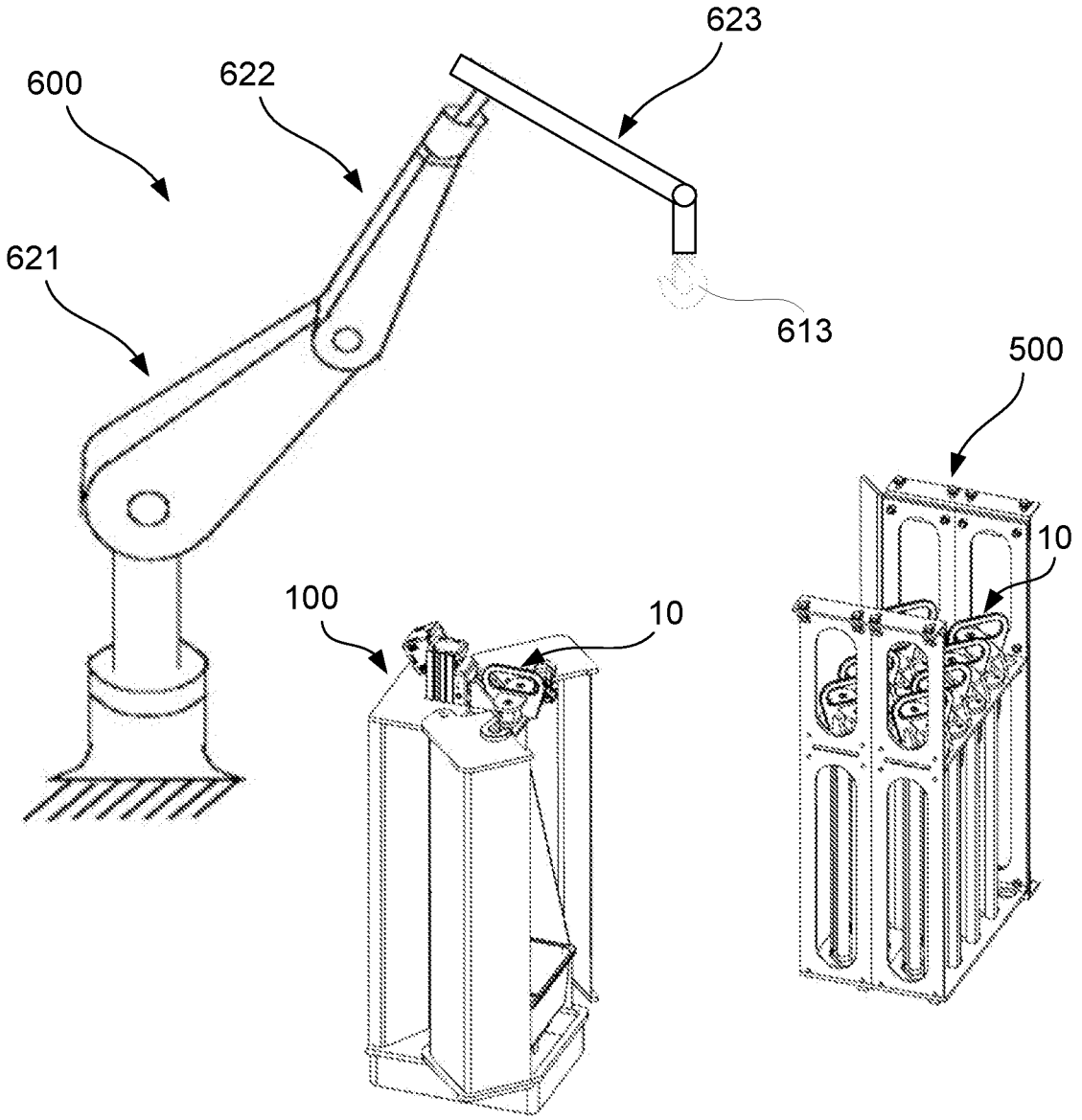

Reference is now made to FIGS. 3A and 3B showing examples of the use of manipulator systems 600 for insertion and removal of magnet assemblies 10 to and from the separate cleaning assembly 100 according to exemplary embodiments. In FIGS. 3A and 3B a typical example of area of use is also shown, i.e. a device 500 comprising a numerous of magnet assemblies 10, as described in WO2016159779, arranged in a material flow, and where the magnet assemblies 10 are to be cleaned when desired. According to various exemplary embodiments the separate cleaning assembly 100 can be arranged in the vicinity of the device 500, and where manipulator systems 600, e.g. as in FIG. 3A in the form of a monorail 610, a traverser carriage 611, and to the traverser carriage 611 arranged a lifting device 612. The lifting device 612 comprises a hook 613 adapted for connection to the magnet handle device 14 for lifting the magnet assembly 10 out of the device 500 and moving it to the separate cleaning assembly 100 by means of the traverser carriage 611 and inserting the magnet assembly 10 into the cleaning assembly 100. The magnet assembly 10 is next cleaned as described above, whereupon the magnet assembly 10 is removed from the cleaning assembly 100 and returned to the device 500 by means of the lifting device 612 and traverser carriage 611. In FIG. 3B is shown an alternative solution where the manipulator system 600 is formed by at least two manipulator arms 621-623 and wherein a hook 613 is arranged at a free end of the manipulator arm 623. By the manipulator arms 621-623 the magnet assembly 10 moved and cleaned as described above for the monorail solution.

By arranging the manipulator system 600 to appropriate control means the entire operation can be automated.

The invention claimed is:

1. A cleaning assembly being separate from and adapted to clean a magnet assembly that includes at least one magnet rod, a wiper assembly and a magnet handle device, the cleaning assembly comprising:

a base;

a vertically extending main body;

a retainer configured to retain the magnet assembly on the main body, said retainer comprising two mirror doors that can pivot relative to the main body and the base;

each of the two mirror doors comprising an upper end plate that includes a contact surface and a recess adapted to receive, accommodate and retain the magnet handle device of the magnet assembly;

a receiver configured to receive and accommodate the wiper assembly; and a mover configured to move the wiper assembly along a longitudinal direction of the at least one magnet rod.

2. The cleaning assembly of claim 1, wherein the mover comprises a driving unit coupled to a vertically extending column arranged on or integrated to the main body.

3. The cleaning assembly of claim 2, wherein the vertically extending column includes a longitudinally extending guide track arranged on a longitudinal side and wherein a vertically extending shaft is located in the vertically extending column.

4. The cleaning assembly of claim 1, further comprising:

a container or box; and a weighing arrangement configured for weighing removed material from the magnet assembly collected in the container or box.

5. The cleaning assembly of claim 1, in combination with a manipulator system for insertion into and removal of the magnet assembly from the cleaning assembly.

6. A cleaning assembly being separate from and adapted to clean a magnet assembly that includes at least one magnet rod, a wiper assembly and a magnet handle device, the cleaning assembly comprising:

a base;

a main body extending vertically from the base;

two pivotally mounted mirror doors that can pivot relative to the main body and the base;

each of the two mirror doors comprising an upper end plate that includes a contact surface and a recess adapted to receive the magnet handle device of the magnet assembly;

a receiver configured to receive and accommodate the wiper assembly; and a mover configured to move the wiper assembly along a longitudinal direction of the at least one magnet rod, wherein, when the two mirror doors are closed, the contact surfaces are disposed adjacent one another.

7. The cleaning assembly of claim 6, further comprising:

a container or box; and a weighing arrangement configured for weighing removed material from the magnet assembly collected in the container or box.

8. The cleaning assembly of claim 6, in combination with a manipulator system for insertion into and removal of the magnet assembly from the cleaning assembly.

9. A cleaning assembly being separate from and adapted to clean a magnet assembly that includes magnet rods, a movable wiper assembly and a magnet handle device, the cleaning assembly comprising:

a base;

a main body extending vertically from the base;

two mirror doors pivotally mounted to the main body;

each of the two mirror doors comprising an upper end plate that includes a contact surface and a recess adapted to accommodate the magnet handle device of the magnet assembly;

a movable receiver configured to receive and accommodate the wiper assembly; and a mover configured to move the wiper assembly relative to magnet rods, wherein, when the two mirror doors are closed, the contact surfaces are disposed adjacent one another and the magnet handle device extends outside of the recesses.

10. The cleaning assembly of claim 9, further comprising:

a container or box; and a weighing arrangement configured for weighing material removed from the magnet assembly by the wiper assembly and collected in the container or box.

11. The cleaning assembly of claim 10, in combination with a manipulator system for insertion into and removal of the magnet assembly from the cleaning assembly.

* * * * *